US010875303B2

(12) United States Patent
Watanabe et al.

(10) Patent No.: US 10,875,303 B2
(45) Date of Patent: Dec. 29, 2020

(54) LIQUID EJECTING HEAD, LIQUID EJECTING APPARATUS, AND WIRING SUBSTRATE

(71) Applicant: Seiko Epson Corporation, Tokyo (JP)

(72) Inventors: Shunsuke Watanabe, Matsumoto (JP); Shingo Tomimatsu, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/451,072

(22) Filed: Jun. 25, 2019

(65) Prior Publication Data

US 2019/0389219 A1 Dec. 26, 2019

(30) Foreign Application Priority Data

Jun. 26, 2018 (JP) ..... 2018-120578

(51) Int. Cl.
*B41J 2/14* (2006.01)
*B41J 2/045* (2006.01)
*B41J 2/45* (2006.01)

(52) U.S. Cl.
CPC ..... *B41J 2/14233* (2013.01); *B41J 2/04581* (2013.01); *B41J 2/1433* (2013.01); *B41J 2002/14258* (2013.01); *B41J 2002/14491* (2013.01); *B41J 2202/13* (2013.01)

(58) Field of Classification Search
CPC ..... B41J 2/14233
See application file for complete search history.

(56) References Cited

U.S. PATENT DOCUMENTS

2011/0074848 A1* 3/2011 Yamashita ..... B41J 2/14233 347/10
2015/0217567 A1* 8/2015 Torimoto ..... B41J 2/161 347/71
2016/0093794 A1* 3/2016 Kakamu ..... B41J 2/1628 310/365
2017/0266969 A1 9/2017 Kashimura
2018/0090664 A1* 3/2018 Kakiuchi ..... B41J 2/1643
2018/0090866 A1* 3/2018 Kakiuchi ..... B41J 2/14201
2018/0111372 A1* 4/2018 Takabe ..... B41J 2/1623

FOREIGN PATENT DOCUMENTS

JP 2017-164944 A 9/2017

* cited by examiner

*Primary Examiner* — Shelby L Fidler
(74) *Attorney, Agent, or Firm* — Hamess, Dickey & Pierce, P.L.C.

(57) ABSTRACT

A liquid ejecting head including a head unit including a mounting surface on which a plurality of first terminals, to which a signal to eject ink from a nozzle is supplied, are formed, and a flexible wiring substrate including a plurality of second terminals that supply the signal to the head unit, the flexible wiring substrate bonded to the head unit with nonconductive paste while the second terminals and the first terminals are in an electrically coupled state, in which the plurality of second terminals are arranged at pitches of 50 μm or less, and in which protrusions in contact with surfaces of the first terminals are formed on surfaces of the second terminals, the protrusions protruding at a height exceeding a surface roughness of the second terminals.

7 Claims, 8 Drawing Sheets

LIQUID EJECTING HEAD, LIQUID EJECTING APPARATUS, AND WIRING SUBSTRATE

The present application is based on, and claims priority from, JP Application Serial Number 2018-120578, filed Jun. 26, 2018, the disclosure of which is hereby incorporated by reference herein in its entirety.

BACKGROUND

1. Technical Field

The present disclosure relates to a technique for ejecting a liquid such as ink.

2. Related Art

For example, JP-A-2017-164944 discloses a liquid ejection apparatus that ejects a liquid by supplying a drive signal to piezoelectric elements. A wiring substrate on which input terminals to which a drive signal for driving the piezoelectric elements is input is formed is bonded to a flexible substrate that supplies the drive signal to the wiring substrate.

In the technique of JP-A-2017-164944, when surfaces of the input terminals of the wiring substrate and surfaces of the terminals of the flexible substrate are both flat, the terminals do not sufficiently come in contact with each other and the reliability of the electrical connection between the terminals may be degraded.

SUMMARY

In order to overcome the above issue, a liquid ejecting head according to a suitable aspect of the present disclosure includes a head unit including a mounting surface on which a plurality of first terminals, to which a signal to eject ink from a nozzle is supplied, are formed; and a flexible wiring substrate including a plurality of second terminals that supply the signal to the head unit, the flexible wiring substrate bonded to the head unit with nonconductive paste while the second terminals and the first terminals are in an electrically coupled state. In the liquid ejecting head, the plurality of second terminals are arranged at pitches of 50 μm or less, and protrusions in contact with surfaces of the first terminals are formed on surfaces of the second terminals, in which the protrusions protrude at a height exceeding a surface roughness of the second terminals.

DESCRIPTION OF EXEMPLARY EMBODIMENTS

First Embodiment

Figure 1:
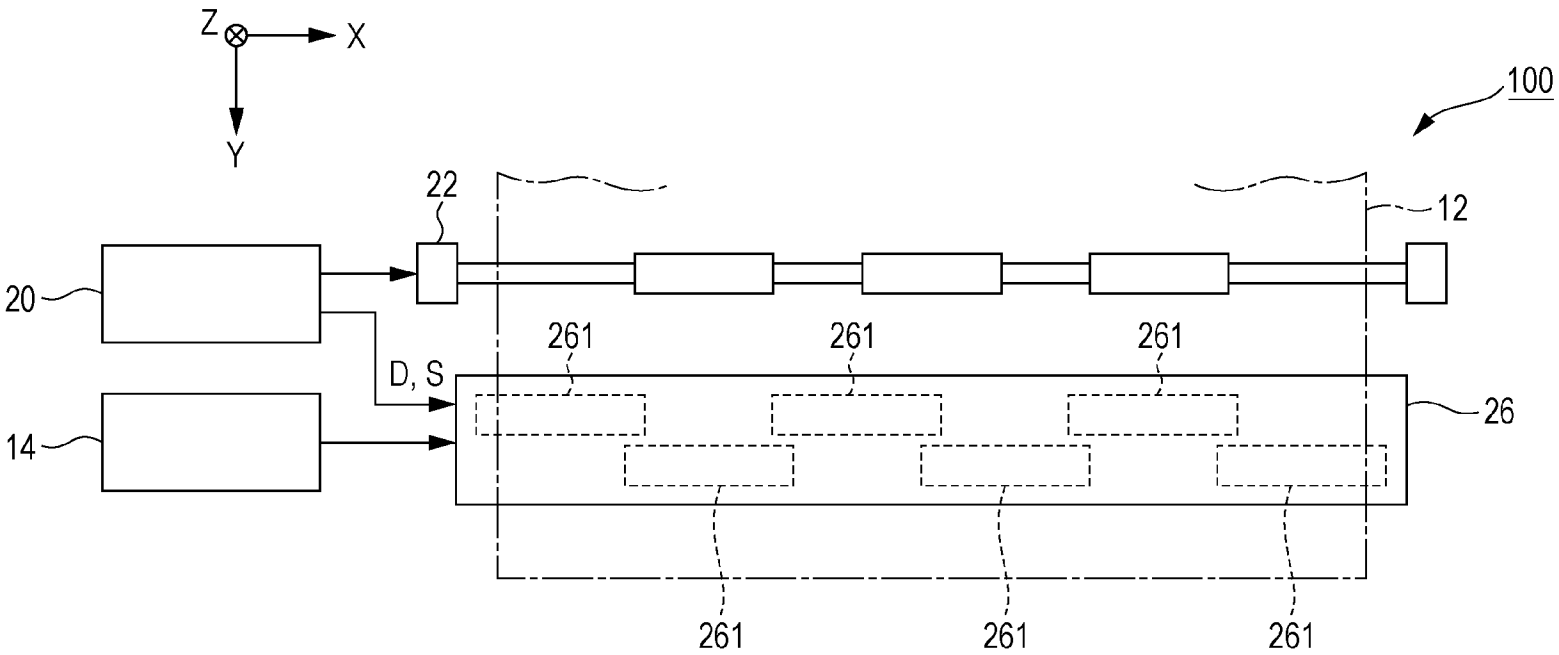
FIG. 1 is a block diagram illustrating a configuration of a liquid ejecting apparatus according to a first embodiment of the present disclosure.

FIG. 1 is a block diagram illustrating an example of a liquid ejecting apparatus 100 according to a first embodiment of the present disclosure. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of a flexible film, or an ink tank into which ink can be refilled is used as the liquid container 14. A plurality of types of inks of different colors are stored in the liquid container 14.

As illustrated as an example in FIG. 1, the liquid ejecting apparatus 100 includes a control unit 20, a transport mechanism 22, and a line head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y direction under the control of the control unit 20.

The line head 26 includes a plurality of liquid ejecting heads 261. Each liquid ejecting head 261 is a structure that ejects ink from nozzles. The plurality of liquid ejecting heads 261 are arranged in an X direction orthogonal to the Y direction. The plurality of liquid ejecting heads 261 are, for example, arranged in a zigzag manner or in a staggered manner. Each liquid ejecting head 261 ejects the ink supplied from the liquid container 14 to the medium 12 under the control of the control unit 20. A desired image is formed on a surface of the medium 12 by having each of the liquid ejecting heads 261 eject ink onto the medium 12 concurrently with the transportation of the medium 12 performed by the transport mechanism 22. Note that a direction perpendicular to an XY plane parallel to the surface of the medium 12 is hereinafter referred to as a Z direction. A direction in which the ink is ejected with each liquid ejecting head 261 corresponds to the Z direction. Typically, the Z direction is the vertical direction.

Figure 2:
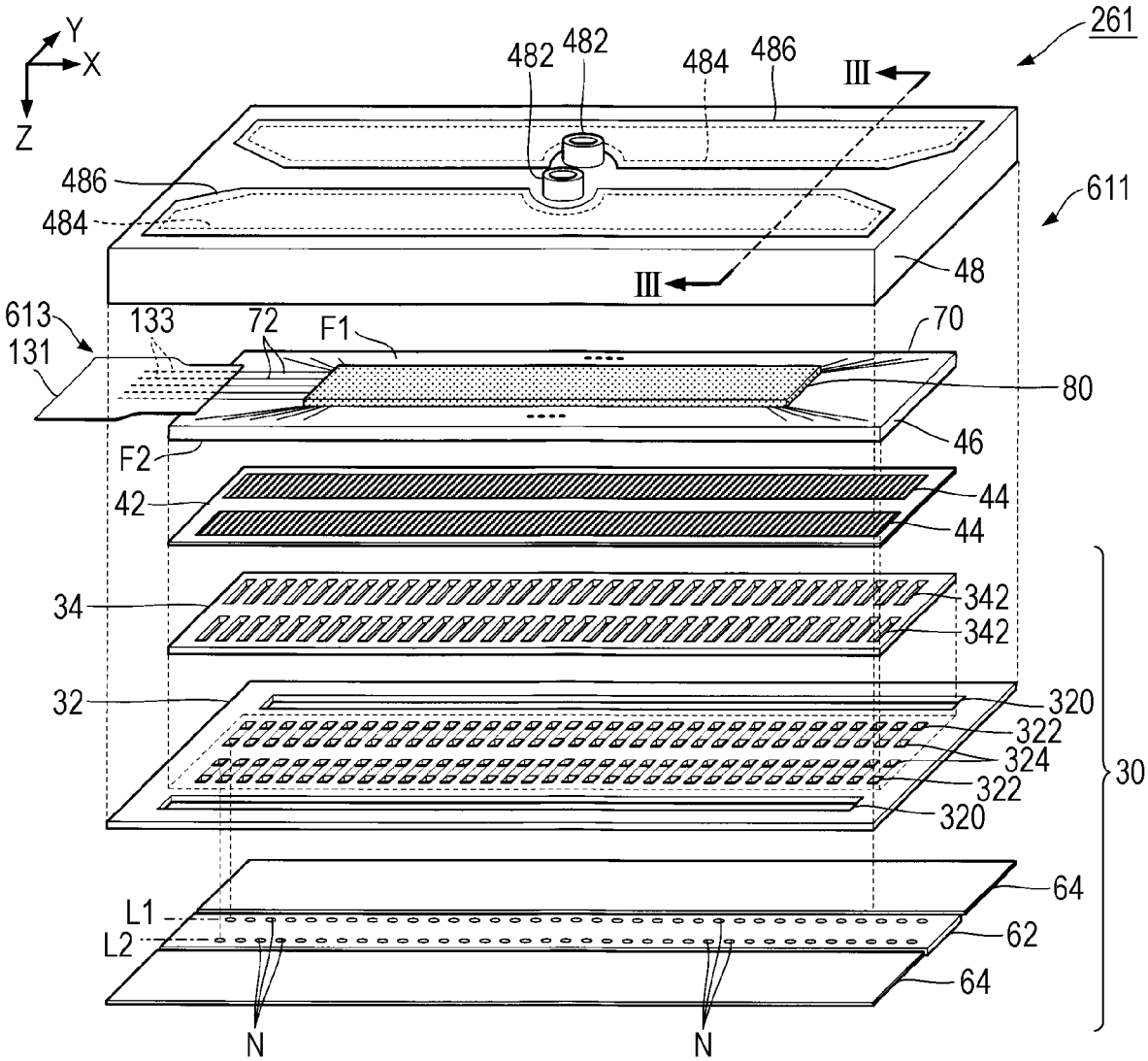
FIG. 2 is an exploded perspective view of a head unit.
Figure 3:
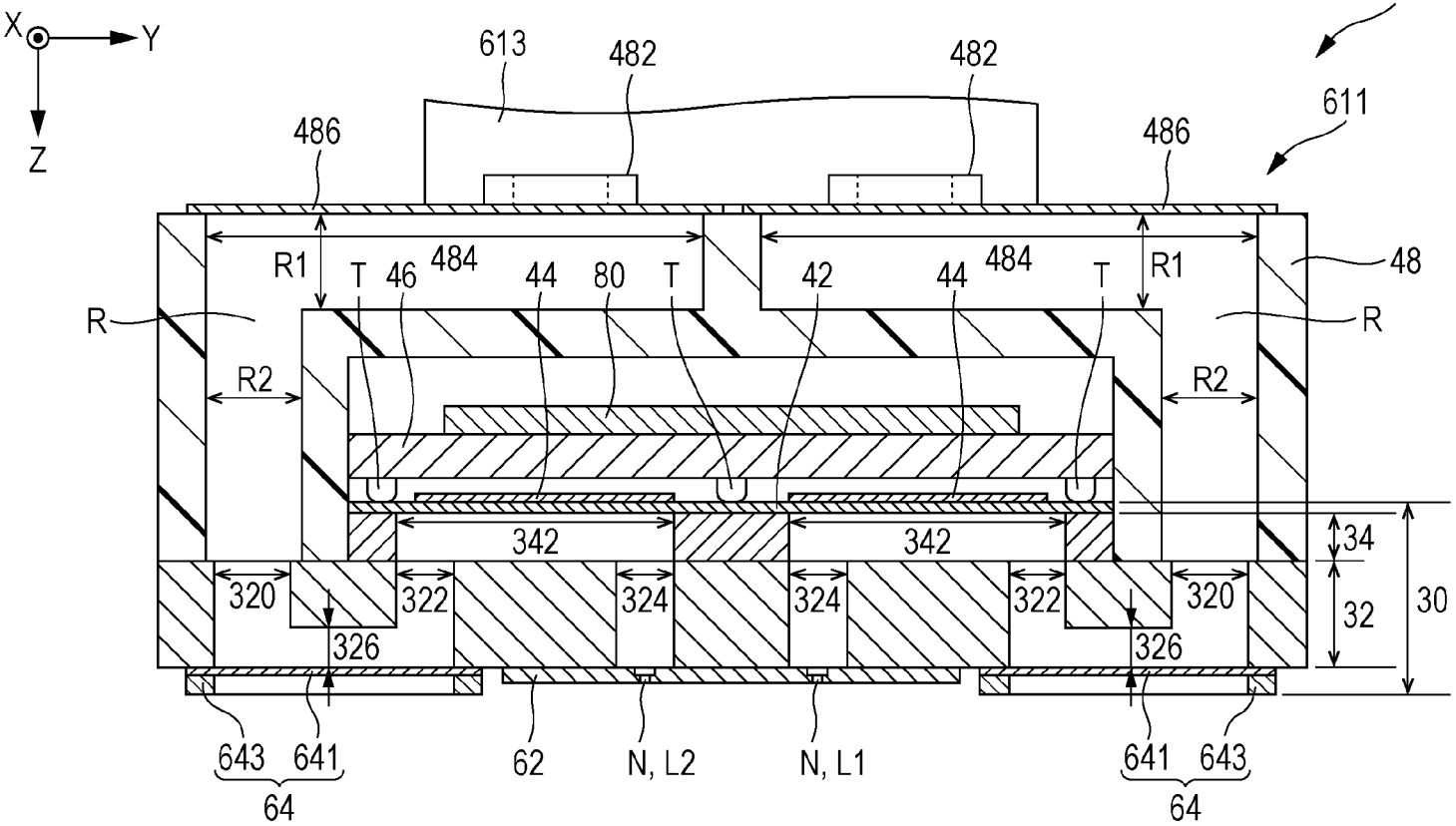
FIG. 3 is a cross-sectional view of the head unit (a cross-sectional view taken along line III-III in FIG. 2).

FIG. 2 is an exploded perspective view of the line head 26, and FIG. 3 is a cross-sectional view taken along line III-III in FIG. 2. As illustrated as an example in FIG. 2, each liquid ejecting head 261 includes a plurality of nozzles N arranged in the X direction. The plurality of nozzles N of the first embodiment are divided into a first line L1 and a second line L2 that are arranged side by side with a space in between in the Y direction. Each of the first line L1 and the second line L2 is a set of a plurality of nozzles N linearly arranged in the Y direction. Note that while the positions of the nozzles N of the first line L1 and those of the second line L2 in the Y direction can be different from each other (in other words, arranged in a zigzag manner or arranged in a staggered manner), for the sake of convenience, a configuration in which the positions of the nozzles N of the first line L1 and those of the second line L2 in the Y direction are set to coincide each other is described below as an example. As it can be understood from FIG. 3, the liquid ejecting head 261 of the first embodiment is structured so that the elements related to each of the nozzles N in the first line L1 and the elements related to each of the nozzles N in the second line L2 are disposed in a substantially axisymmetric manner.

Figure 4:
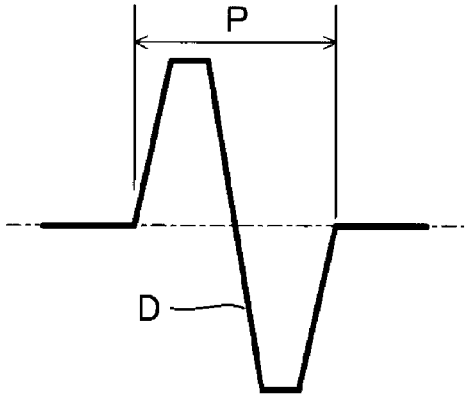
FIG. 4 is a waveform diagram of a drive signal.

As illustrated as an example in FIGS. 2 and 3, each liquid ejecting head 261 includes a head unit 611 that ejects ink from the nozzles N, and a second wiring substrate 613. The control unit 20 and the head units 611 are electrically coupled to each other with the second wiring substrate 613. The control unit 20 in FIG. 1 generates a signal and voltage to eject the ink from the nozzles. For example, a control signal S and a drive signal D are generated by the control unit 20. The control signal S instructs each nozzle N whether or not to eject ink (ejection/non-ejection). The drive signal D is a periodic signal whose voltage changes across a predetermined base voltage, and is used to make the head unit 611 eject ink. As illustrated as an example in FIG. 4, the drive signal D is a voltage signal including a drive pulse P in each predetermined period. Note that the drive signal D having a waveform including a plurality of drive pulses P may be used. The drive signal D and the control signal S generated by the control unit 20 are supplied to each head unit 611 through the second wiring substrate 613.

As illustrated in FIGS. 2 and 3, each head unit 611 includes a flow path structure 30, piezoelectric elements 44, a first wiring substrate 46, a containing body 48, and a drive circuit 80. The flow path structure 30 is a structure that forms flow paths that supply ink to the plurality of nozzles N. The flow path structure 30 of the first embodiment includes a flow path substrate 32, a pressure chamber substrate 34, a diaphragm 42, a nozzle plate 62, and first vibration absorbers 64. Each member constituting the flow path structure 30 is a plate-shaped member elongated in the X direction. The containing body 48 and the pressure chamber substrate 34 are provided on a surface of the flow path substrate 32 on a negative side in the Z direction. On the other hand, the nozzle plate 62 and the first vibration absorbers 64 are provided on a surface of the flow path substrate 32 on a positive side in the Z direction. Each member is fixed with an adhesive agent, for example.

The nozzle plate 62 is a plate-shaped member having the plurality of nozzles N formed therein. Each of the plurality of nozzles N is a circular through hole through which ink passes. In the nozzle plate 62 of the first embodiment, the plurality of nozzles N constituting the first line L1 and the plurality of nozzles N constituting the second line L2 are formed. The nozzle plate 62 is fabricated by processing a single crystal substrate formed of silicon (Si) using a semiconductor manufacturing technique (for example, a processing technique such as dry etching or wet etching), for example. However, any known materials and any manufacturing methods can be adopted to manufacture the nozzle plate 62.

As illustrated in FIGS. 2 and 3, opening portions 320, a plurality of supply flow paths 322, a plurality of communication flow paths 324, and a plurality of connection flow paths 326 are formed for each of the first line L1 and the second line L2 of the flow path substrate 32. Each opening portion 320 is an elongated opening formed in the X direction in a plan view (that is, when viewed in the Z direction), and the supply flow paths 322 and the communication flow paths 324 are through holes formed for each nozzle N. Each connection flow path 326 is an elongated space formed in the X direction across a plurality of nozzles N, and communicates the opening portions 320 and the plurality of supply flow paths 322 to each other. Each of the plurality of communication flow paths 324 overlaps a corresponding single nozzle N in plan view.

As illustrated as an example in FIGS. 2 and 3, the pressure chamber substrate 34 is a plate-shaped member in which a plurality of pressure chambers 342 are formed in each of the first line L1 and the second line L2. The plurality of pressure chambers 342 are arranged in the X direction. Each of the pressure chambers 342 (cavities) is an elongated space that is formed for each nozzle N and that extends in the Y direction in a plan view. Similar to the nozzle plate 62 described above, for example, the flow path substrate 32 and the pressure chamber substrate 34 are fabricated by processing a single crystal substrate formed of silicon using a semiconductor manufacturing technique. However, any known materials and any manufacturing methods can be adopted to manufacture the flow path substrate 32 and the pressure chamber substrate 34.

As illustrated in FIG. 2, the diaphragm 42 is formed on a surface of the pressure chamber substrate 34 opposite the flow path substrate 32. The diaphragm 42 of the first embodiment is a plate-shaped member configured to vibrate elastically. Note that portions or the entire diaphragm 42 can be formed so as to be integrated with the pressure chamber substrate 34 by selectively removing the plate-shaped member having a predetermined plate thickness at portions corresponding to the pressure chambers 342 in the plate thickness direction.

As can be understood from FIG. 3, the pressure chambers 342 are spaces located between the flow path substrate 32 and the diaphragm 42. Regarding each of the first line L1 and the second line L2, the plurality of pressure chambers 342 are arranged in the X direction. As illustrated in FIGS. 2 and 3, the pressure chambers 342 are in communication with the communication flow paths 324 and the supply flow paths 322. Accordingly, the pressure chambers 342 are in communication with the nozzles N through the communication flow paths 324 and are in communication with the opening portions 320 through the supply flow paths 322 and the connection flow paths 326.

As illustrated in FIGS. 2 and 3, the piezoelectric elements 44 are positioned on a surface of the flow path structure 30 on a side opposite the nozzles N. Specifically, in each of the first line L1 and the second line L2, the plurality of piezoelectric elements 44 each corresponding to different nozzles N are formed on the surface of the diaphragm 42 of the flow path structure 30 on a side opposite the pressure chambers 342. Each piezoelectric element 44 is a passive element that changes the pressure in the corresponding pressure chamber 342 by being deformed by a drive signal D supplied from the drive circuit 80. The drive signal output D output from the drive circuit 80 is supplied to each piezoelectric element 44 through connection terminals T of the first wiring substrate 46. The drive signal D is supplied to the drive circuit 80 from the control unit 20 through the second wiring substrate 613.

The drive circuit 80 is configured to include a plurality of switches each corresponding to a different piezoelectric element 44, and performs, on for each piezoelectric element 44, control of whether to supply the drive pulse P of the drive signal D to the piezoelectric elements 44 according to the control signal S. Specifically, the drive circuit 80 supplies the drive pulse P to the piezoelectric element 44 corresponding to the nozzle N to which the control signal S has instructed an ejection of ink, and does not supply the drive pulse P to the piezoelectric element 44 corresponding to the nozzle N to which the control signal S has not instructed a non-ejection of ink.

The first wiring substrate 46 in FIG. 2 is a plate-shaped member opposing the surface of the diaphragm 42, on which the plurality of piezoelectric elements 44 are formed, with a gap in between. In other words, the first wiring substrate 46 is positioned on the side opposite the flow path structure 30 with respect to the piezoelectric elements 44. Wiring that electrically couples the drive circuit 80 and the piezoelectric elements 44 to each other is formed in the first wiring substrate 46. The first wiring substrate 46 of the first embodiment also functions as a reinforcing plate that reinforces the mechanical strength of the liquid ejecting head 261 and a sealing plate that protects and seals the piezoelectric elements 44.

The first wiring substrate 46 is electrically coupled to the control unit 20 through the second wiring substrate 613. The second wiring substrate 613 is a flexible wiring substrate that supplies various signals including the drive signal D and the control signal S or voltages from the control unit 20 to the first wiring substrate 46. An end portion of the second wiring substrate 613 is bonded to the first wiring substrate 46. In FIG. 2, the end portion of the second wiring substrate 613 on the positive side in the X direction and an end portion of the first wiring substrate 46 on the negative side in the X direction are bonded to each other. For example, a connecting component such as a flexible printed circuit (FPC) or a flexible flat cable (FFC) is suitably adopted as the second wiring substrate 613.

The containing body 48 is a case that stores the ink supplied to the plurality of pressure chambers 342. A surface of the containing body 48 on the positive side in the Z direction is bonded to the flow path substrate 32 with, for example, an adhesive agent. Specifically, the containing body 48 is, in a plan view, a structure inside of which liquid storage chambers (reservoirs) R elongated in the X direction are formed. In the first embodiment, the liquid storage chambers R are formed for each of the first line L1 and the second line L2. As illustrated in FIG. 3, each liquid storage chamber R includes a first space R1 extending in the Y direction and a second space R2 extending in the Z direction in a cross-sectional view. In the liquid storage chamber R, the first space R1 overlaps the piezoelectric elements 44 in a plan view. In each liquid storage chamber R, the corresponding second space R2 and the corresponding opening portion 320 of the flow path substrate 32 are in communication with each other. Ink is supplied to the liquid storage chambers R through the inlets 482 formed in the containing body 48. The inlets 482 are each a tubular portion that communicates the corresponding liquid storage chamber R of the containing body 48 to a portion external to the containing body 48. The ink inside the liquid storage chambers R is supplied to the pressure chambers 342 through the connection flow paths 326 and the supply flow path 322. The containing body 48 is formed, for example, by injection molding a resin material. The drive circuit 80 is disposed in the space formed by the containing body 48.

Opening portions 484 are formed in the containing body 48 of the first embodiment. Each opening portion 484 is an opening formed elongated in the X direction so as to overlap the corresponding liquid storage chamber R. As illustrated as an example in FIGS. 2 and 3, second vibration absorbers 486 are provided on an upper surface of the containing body 48. Each second vibration absorber 486 is a flexible film that functions as a compliance substrate that absorbs pressure fluctuations of the ink inside the corresponding liquid storage chamber R, and is installed on the upper surface of the containing body 48 so as to close the corresponding opening portion 484 to constitute a wall surface of the liquid storage chamber R.

As illustrated as an example in FIG. 3, the first vibration absorbers 64 are elements that absorb pressure fluctuations of the ink inside the liquid storage chambers R. The first vibration absorbers 64 of the first embodiment each include an elastic film 641 and a support plate 643. The elastic film 641 is a flexible member formed in a film shape. Each elastic film 641 of the first embodiment is disposed on the surface of the flow path substrate 32 so as to close the corresponding opening 320, the corresponding supply flow path 322, and the corresponding connection flow path 326. The support plate 643 is a flat plate formed of a material with high rigidity such as stainless steel, and supports the elastic film 641 on the surface of the flow path substrate 32 so that the opening formed in the flow path substrate 32 is closed by the elastic film 641. The pressure fluctuation inside each liquid storage chamber R is suppressed by deforming the corresponding elastic film 641 according to the pressure of the ink in the storage chamber R.

As illustrated as an example in FIG. 2, the second wiring substrate 613 includes a second base portion 131 and a plurality of second wires 133. The second base portion 131 is a flexible film-like member elongated in the X direction, and a plurality of second wires 133 are formed on the surface opposing the first wiring substrate 46. The plurality of second wires 133 electrically couples the control unit 20 and the first wiring substrate 46 to each other.

Figure 5:
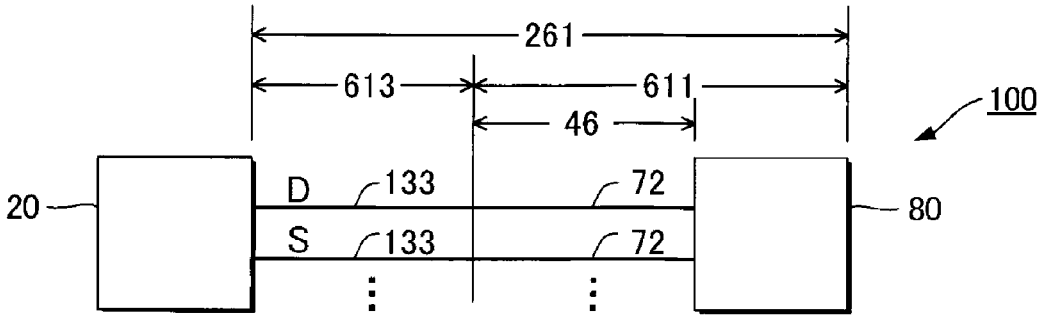
FIG. 5 is a block diagram illustrating a functional configuration of the liquid ejecting apparatus.

FIG. 5 is a block diagram illustrating a functional configuration of the liquid ejecting apparatus 100. As illustrated as an example in FIG. 5, various signals and voltages generated by the control unit 20 are transmitted to the first wiring substrate 46 with the plurality of second wires 133. Specifically, the second wires 133 to which the drive signal D is supplied and the second wires 133 to which the control signal S is supplied are formed on the second wiring substrate 613. Note that in FIG. 5, illustration of the second wires 133 that transmit a signal and voltage different from the drive signal D and the control signal S are omitted.

As illustrated as an example in FIG. 2, the first wiring substrate 46 includes a first base portion 70 and a plurality of first wires 72. The first base portion 70 is an insulating plate-shaped member elongated in the X direction, and is positioned between the flow path structure 30 and the drive circuit 80. The first base portion 70 is fabricated by processing a single crystal substrate formed of silicon using a semiconductor manufacturing technique, for example. However, any known materials and any manufacturing methods can be adopted to manufacture the first base portion 70.

The first base portion 70 includes a first surface F1 and a second surface F2 positioned opposite each other, and is fixed to a surface of the diaphragm 42 on a side opposite the flow path substrate 32 using an adhesive agent, for example. Specifically, the first base portion 70 is provided so that the second surface F2 opposes the surface of the diaphragm 42 with a gap in between.

The plurality of first wires 72 are formed at an end portion of the first surface F1 of the first base portion 70 on the negative side in the X direction. The plurality of first wires 72 electrically couple the second wiring substrate 613 and the drive circuit 80 to each other. The plurality of first wires 72 are formed to correspond to the plurality of second wires 133 of the second wiring substrate 613. The drive signal D and the control signal S supplied from the second wiring substrate 613 are transmitted to the drive circuit 80 through the plurality of first wires 72. Specifically, as illustrated as an example in FIG. 5, the first wiring substrate 46 includes the first wires 72 to which the drive signal D is supplied and the first wires 72 to which the control signal S is supplied.

The head unit 611 and the second wiring substrate 613 are bonded to each other by an adhesive agent. Nonconductive paste is used as the adhesive agent. Specifically, in the head unit 611, the first wiring substrate 46 and the second wiring substrate 613 are bonded to each other. A portion (typically, an end portion) of each of the second wires 133 of the second wiring substrate 613 functions as a second terminal T2 that supplies the drive signal D and the control signal S to the head unit 611. A portion (typically, an end portion) of each of the first wires 72 of the first wiring substrate 46 functions as a first terminal T1 to which the drive signal D and the control signal S are supplied. The first surface F1 of the first base portion 70 functions as a mounting surface on which the first terminals T1 are formed. In a state in which the first terminals T1 and the second terminals T2 are electrically coupled to each other, the first wiring substrate 46 and the second wiring substrate 613 of the head unit 611 are bonded to each other. Accordingly, as illustrated as an example in FIG. 5, the drive signal D and the control signal S generated by the control unit 20 are supplied to the drive circuit 80 through the second wiring substrate 613 and the first wiring substrate 46.

Figure 6:
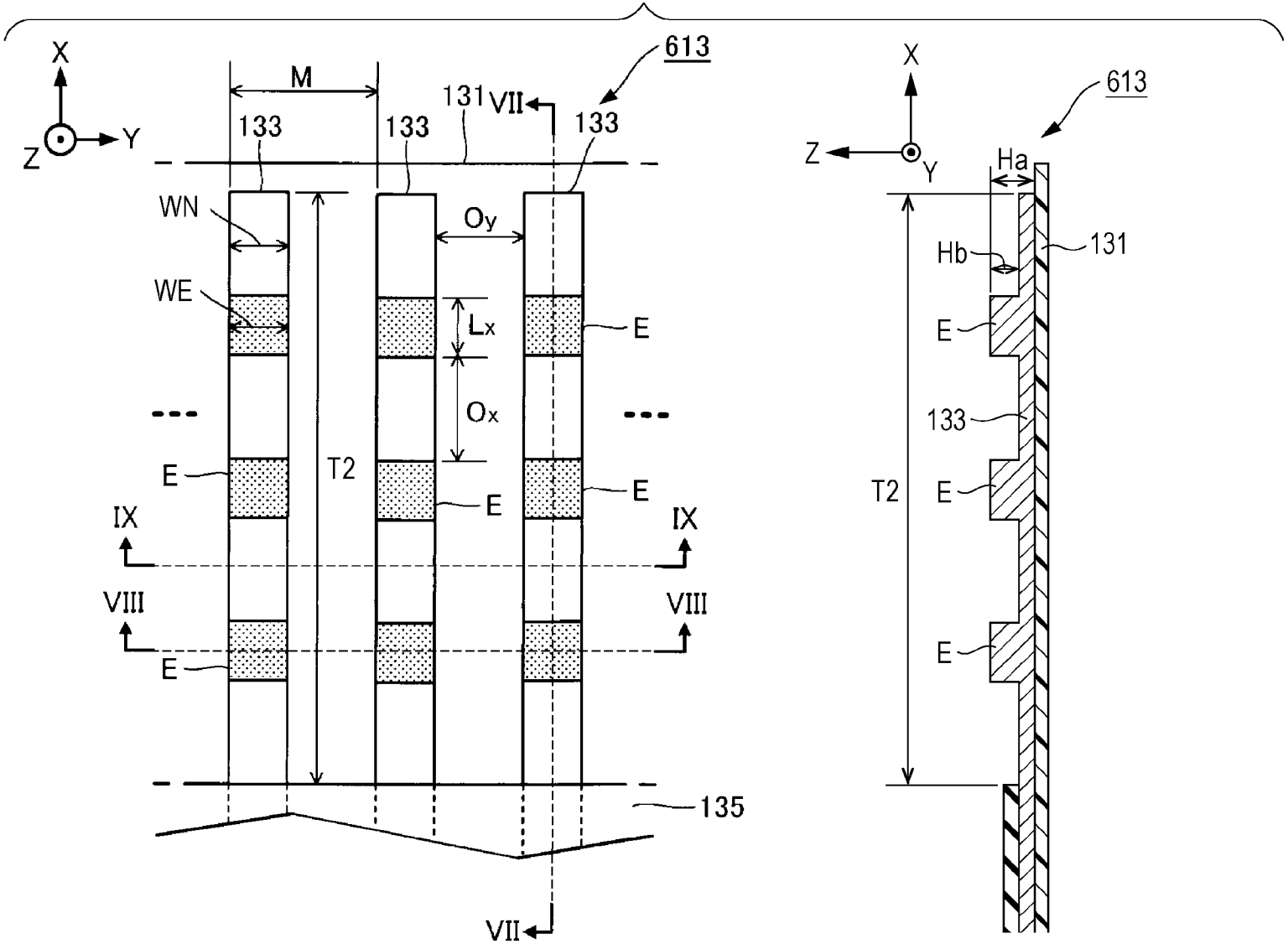
FIG. 6 includes a plan view and a cross-sectional view of a second wiring substrate.

FIG. 6 includes a plan view (the left drawing) and a cross-sectional view (the right drawing) of the second wiring substrate 613. The second wiring substrate 613 includes an insulating film 135 that covers a portion of the second base portion 131. Portions of the second wires 133 exposed from a peripheral edge of the insulating film 135 are the second terminals T2. As illustrated as an example in FIG. 6, the plurality of second terminals T2 are formed in the second base portion 131 at predetermined intervals Oy in the Y direction. For example, the plurality of second terminals T2 are arranged at a pitch M of 50 μm or less. The pitch M is a distance between peripheral edges of two adjacent second terminals T2 on the negative side in the Y direction. The pitch M is also referred to as the sum of the interval Oy between two second terminals T2 adjacent to each other in the Y direction and the width of the second terminal T2.

As illustrated as an example in FIG. 6, protrusions E protruding from a surface of the second terminal T2 is formed on the surface thereof. In FIG. 6, hatching is added to the protrusions E for convenience sake. The protrusions E protrude from the surface of the second terminal T2 toward the first wiring substrate 46. The planar shape of each protrusion E is, for example, a rectangle. In the first embodiment, the plurality of protrusions E are formed on the surface of each second terminal T2 at predetermined intervals Ox in the X direction in which the second terminal T2 extends. In the first embodiment, in the two second terminals T2 adjacent to each other in the Y direction, positions of the protrusions E in the X direction in which the second terminals T2 extend are the same. In other words, the plurality of protrusions E corresponding to each other are arranged in the Y direction in the plurality of second terminals T2. Furthermore, in the first embodiment, the protrusions E are formed across the entire width of each second terminal T2. In other words, widths WE of the protrusions E are equal to widths WN of portions other than the protrusions E in each second terminal T2.

The interval Ox between two protrusions E adjacent to each other in the X direction among the plurality of protrusions E formed in each second terminal T2 exceeds a length Lx of each protrusion E in the X direction in which the second terminal T2 extends (Ox>Lx). Furthermore, the interval Oy between two second terminals T2 exceeds the length Lx of each protrusion E in the X direction in which the second terminal T2 extend (Oy>Lx).

As illustrated as an example in the cross-sectional view in FIG. 6, each protrusion E protrudes at a height Hb that exceeds a surface roughness of each second terminal T2. The surface roughness of each second terminal T2 is, for example, 2 μm or less. The protrusion E of the first embodiment protrudes at the same height Hb throughout the protrusion E. In other words, the cross-sectional shape of the protrusion E is a rectangle. The height Hb of the protrusions E exceeds half the thickness Ha of the second terminals T2 at portions where the protrusions E are situated, (Hb>Ha/2), for example. The thickness Ha of the second terminal T2 is a length between the contact surface of the second terminal T2 in contact with the second base portion 131 and the surface of the protrusion E. It can also be said that the maximum value of the length of the second terminal T2 in the Z direction is the thickness of the second terminal T2. Specifically, the thickness Ha of the second terminal T2 is 9 μm, for example. The height Hb of each protrusion E is a length between the surface of the portion other than the protrusion E to the surface of the protrusion E in the second terminal T2. Specifically, the height Hb of the protrusion E is, for example, 6 μm.

Figure 7:
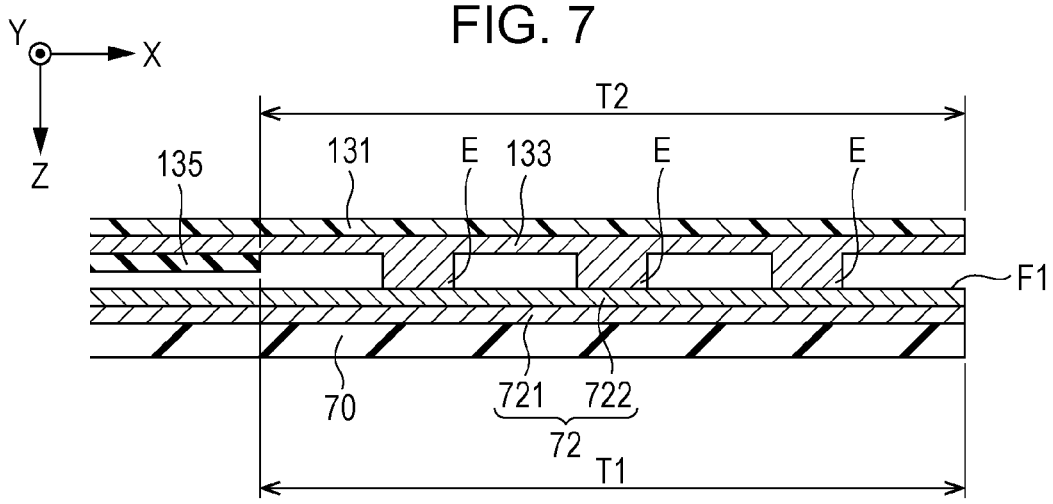
FIG. 7 is a cross-sectional view of a state in which the first wiring substrate and the second wiring substrate are bonded to each other (a cross-sectional view taken along line VII-VII in FIG. 6).
Figure 8:
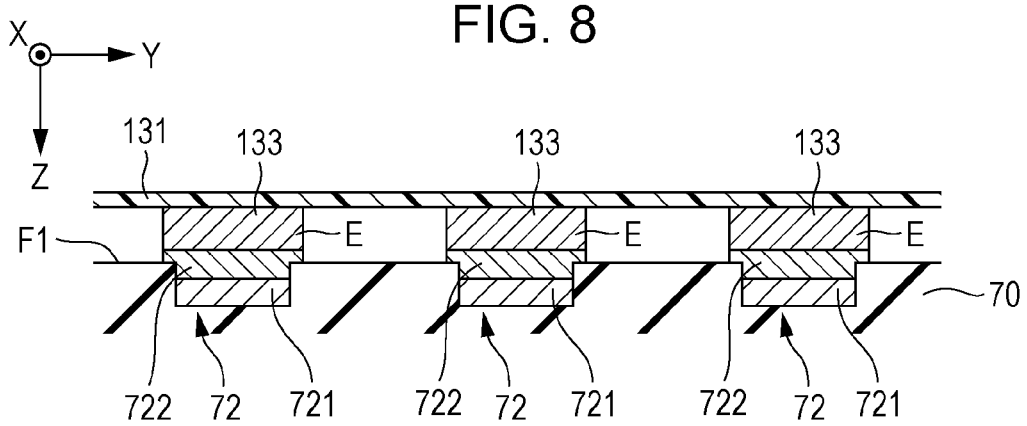
FIG. 8 is a cross-sectional view of the state in which the first wiring substrate and the second wiring substrate are bonded to each other (a cross-sectional view taken along line VIII-VIII in FIG. 6).
Figure 9:
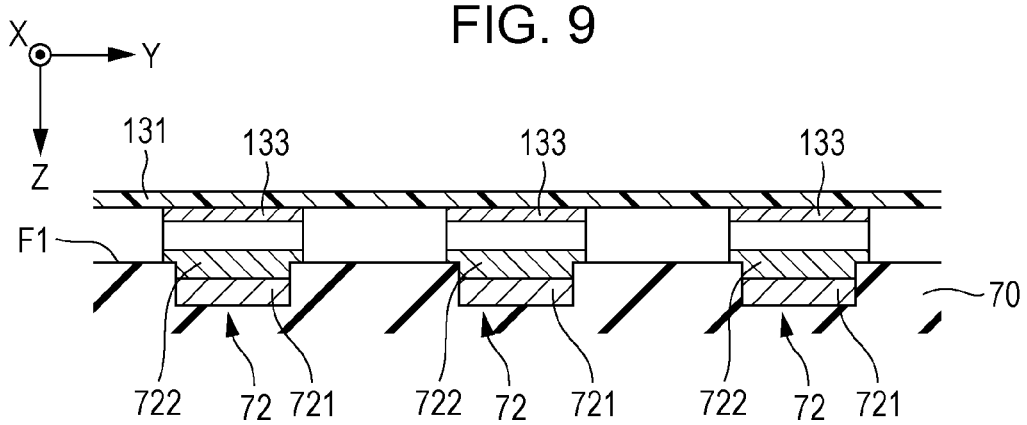
FIG. 9 is a cross-sectional view of the state in which the first wiring substrate and the second wiring substrate are bonded to each other (a cross-sectional view taken along line IX-IX in FIG. 6).

FIGS. 7 to 9 are cross-sectional views of a state in which the first wiring substrate 46 and the second wiring substrate 613 are bonded to each other. FIG. 7 is a cross-sectional view taken along line VII-VII in FIG. 6, FIG. 8 is a cross-sectional view taken along line VIII-VIII in FIG. 6, and FIG. 9 is a cross-sectional view taken along line IX-IX in FIG. 6. In other words, FIG. 8 is a cross-sectional view of a section passing through the protrusions E of the plurality of second wires 133, and FIG. 9 is a cross-sectional view of a section passing through portions other than the protrusions E of the plurality of second wires 133.

As illustrated in FIG. 7, each first wire 72 of the first wiring substrate 46 is a wire formed by layering a plurality of conductive layers. As illustrated as an example in FIGS. 8 and 9, in the first surface F1 of the first base portion 70, grooves are formed that extend along the laminated wiring. Each groove is a recessed portion having a rectangular section recessed with respect to the first surface F1 of the first base portion 70. Each first wire 72 is constituted by layers of first layered wiring 721 and second layered wiring 722. Each first layered wiring 721 is a conductive pattern formed of metal such as, for example, copper (Cu) having a low resistance. As illustrated as an example in FIG. 8, the first layered wiring 721 is a trench wiring formed inside the groove. Meanwhile, each second layered wiring 722 is a conductive pattern that covers the corresponding first layered wiring 721. Each second layered wiring 722 covers the first layered wiring 721 inside the corresponding groove and continues to the first surface F1 of the first base portion 70. Specifically, the second layered wiring 722 is constituted by layers of, for example, an adhesion layer that is formed of metal such as titanium (T1) or tungsten (W) and that is formed on a surface of the first layered wiring 721, and a wiring layer that is formed of metal such as gold (Au) and that is formed on a surface of the adhesion layer. The adhesion layer is a conductive layer that improves adhesion between the first layered wiring 721 and the wiring layer. Portions of the first wires 72 opposing the second terminals T2 function as the first terminals T1.

As illustrated in FIGS. 7 and 8, the surfaces of the protrusions E of the second terminals T2 contact the surfaces of the first terminals T1. In other words, in a state in which the first terminals T1 and the second terminals T2 are electrically coupled to each other, the first wiring substrate 46 and the second wiring substrate 613 are bonded to each other. On the other hand, as illustrated in FIG. 9, portions of the second terminals T2 other than the protrusions E do not contact the surface of the first terminals T1. Nonconductive paste is interposed between the surfaces of the second terminals T2 other than the protrusions E and the surfaces of the first terminals T1. Note that the portions of the second terminals T2 other than the protrusions E may be in contact with the surface of the first terminals T1.

In order to electrically couple the terminals with the nonconductive paste, the surfaces of the terminals need to be sufficiently in close contact with each other. For example, in a configuration (hereinafter, referred to as a "comparative example") in which terminals having flat surfaces are bonded to each other, there are cases in which the terminals are not sufficiently in contact with each other, and the reliability of the electrical connection between the terminals are degraded. It is presumed that the terminals do not sufficiently contact each other, for example, due to unevennesses formed on the surfaces of the terminals owing to technical manufacturing problems and the terminals not contacting each other sufficiently. When the terminals are not sufficiently in contact with each other, there is a problem that the signal is not accurately supplied from one of the terminals to the other terminal, or the terminals generate heat due to the contact portions becoming high in resistance. Conversely, in the first embodiment, since the protrusions E are formed in the second terminals T2, the first terminals T1 and the second terminals T2 are sufficiently in contact with each other while the protrusions E are pressed and deformed by the first terminals T1. Accordingly, compared with the comparative example, the reliability of the electrical connection between the first terminals T1 and the second terminals T2 is larger.

In the configuration of the first embodiment in which the plurality of protrusions E are formed in the X direction in which the second terminals T2 extend, there is an significant effect in the increase in the reliability of the electrical connections between the first terminals T1 and the second terminals T2. In the first embodiment, since the intervals Ox between two adjacent protrusions E formed in the second terminals T2 exceed the lengths Lx of the protrusions E in the direction in which the second terminals T2 extend, there is an advantage that spaces in which the protrusions E deform can be sufficiently obtained.

Note that when a distance between the protrusions E of two second terminals T2 is small, short circuiting may occur due to deformation of the protrusion E. In the first embodiment, since the interval Oy between two second terminals T2 adjacent to each other is greater than the length of the protrusion E in the direction in which the second terminals T2 extend, a distance between is obtained between the protrusions E of the two second terminals T2. Accordingly, the possibility of short circuiting happening owing to the deformation of the protrusions E can be reduced.

Second Embodiment

A second embodiment of the present disclosure will be described. Note that in the following examples, elements having functions similar to those of the first embodiment will be denoted by applying the reference numerals used in the description of the first embodiment, and detailed description of the elements will be omitted appropriately.

Figure 10:
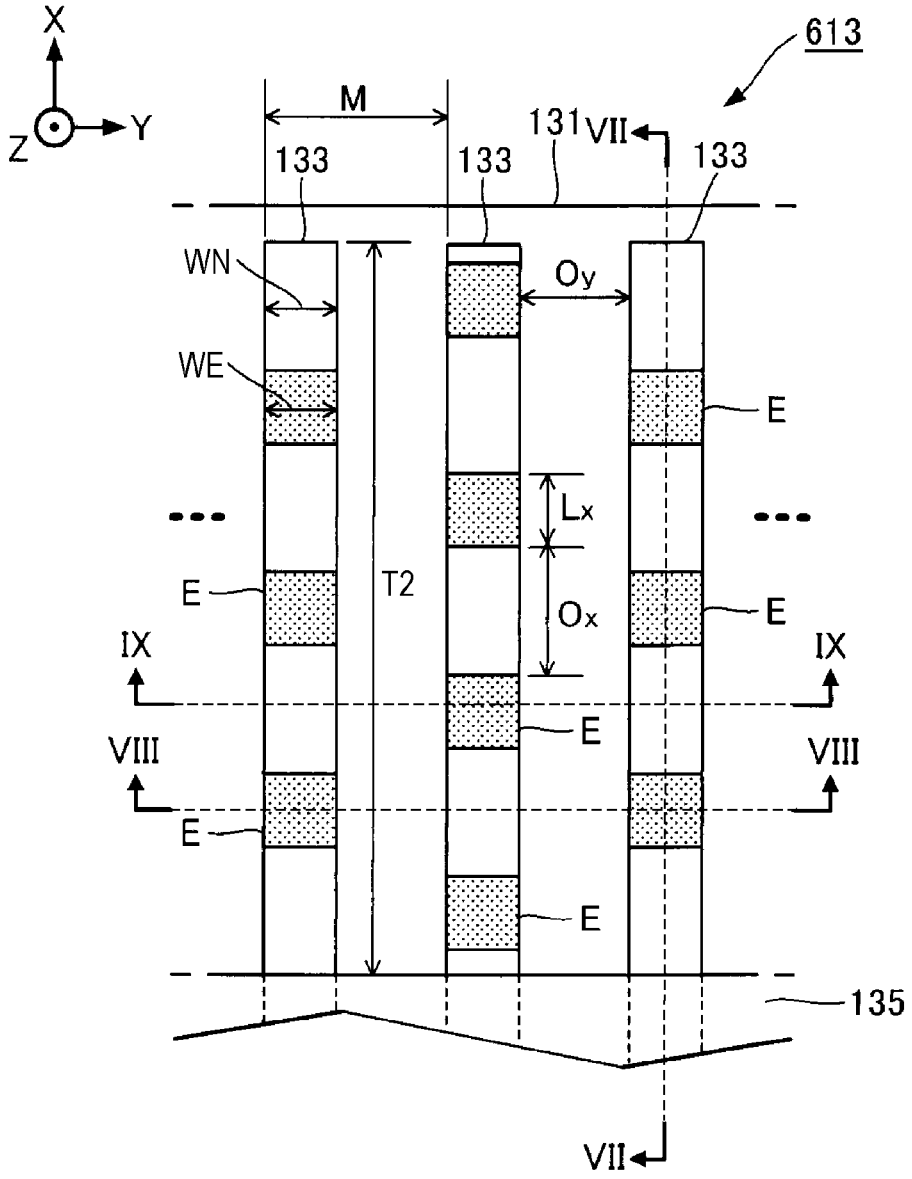
FIG. 10 is a plan view of a second wiring substrate according to a second embodiment.

FIG. 10 is a plan view of a second wiring substrate 613 according to the second embodiment. In the first embodiment, in two second terminals T2 adjacent to each other among the plurality of second terminals T2, the positions of the protrusions E in the X direction in which the second terminals T2 extend are the same. On the other hand, as illustrated as an example in FIG. 10, in the second embodiment, in two second terminals T2 adjacent to each other among the plurality of second terminals T2, the positions of the protrusions E in the X direction in which the second terminals T2 extend are not the same. Specifically, the protrusions E of one second terminal T2 are formed at positions corresponding to the intervals Ox between the two protrusions E of the other second terminal T2 in the X direction. Typically, the protrusions E of one second terminal T2 is formed at positions corresponding to middle points of the intervals Ox in the other second terminal T2. In other words, in the arrangement of the plurality of second terminals T2, the positions of the protrusions E are different between the even-numbered second terminals T2 and the odd-numbered second terminals T2.

In the two second terminals T2 adjacent to each other having the configuration in which the positions of the protrusions E in the direction in which the second terminals T2 extend are the same, the protrusions E approach each other due to deformation thereof and short circuiting may occur between the two second terminals T2. On the other hand, in the second embodiment, in the two second terminals T2 adjacent to each other among the plurality of second terminals T2, the positions of the protrusions E in the X direction in which the second terminals T2 extend are not the same; accordingly, a distance is obtained between the protrusions E of the two second terminals T2. Accordingly, the possibility of short circuiting happening owing to the deformation of the protrusions E can be reduced.

Third Embodiment

Figure 11:
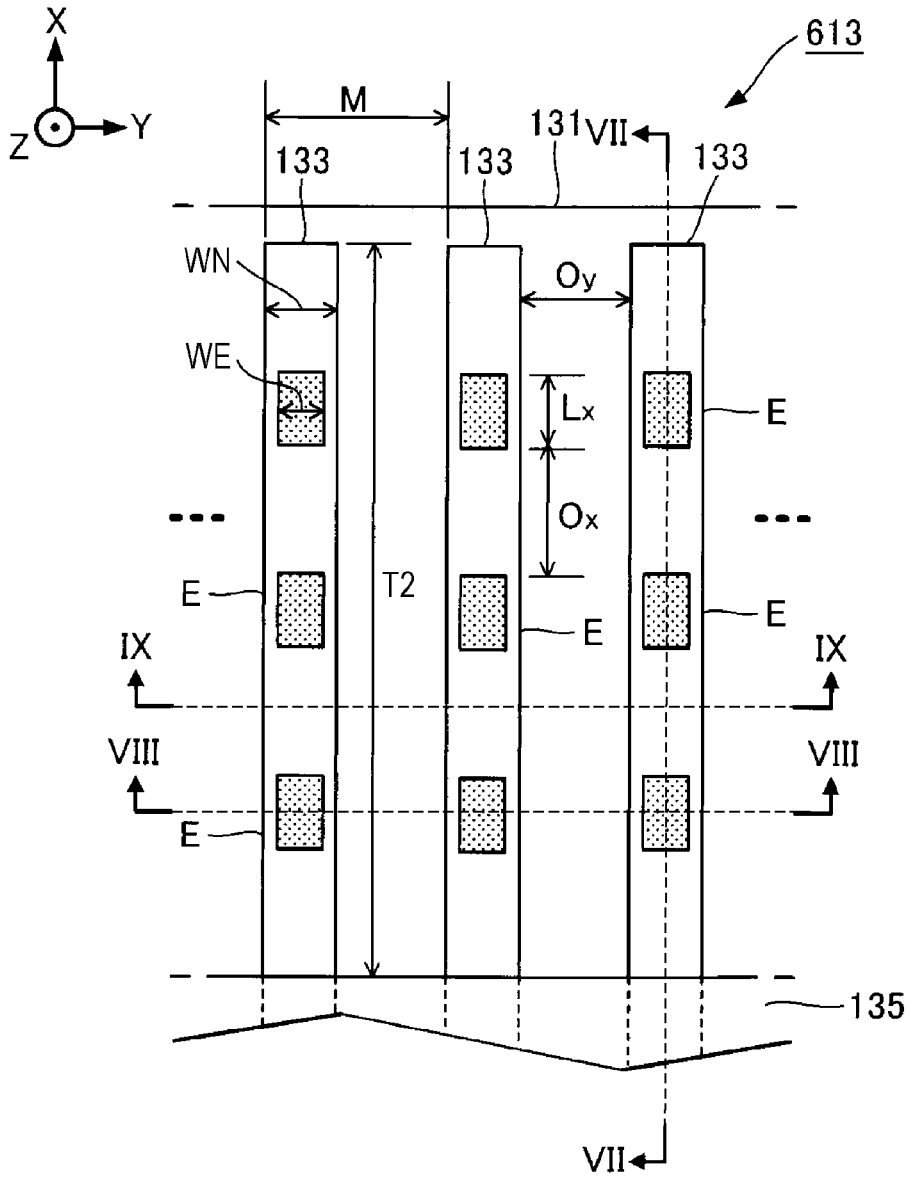
FIG. 11 is a plan view of a second wiring substrate according to a third embodiment.

FIG. 11 is a plan view of a second wiring substrate 613 according to the third embodiment. In the first embodiment, the widths WE of the protrusions E are equal to the widths WN of the portions of the second terminals T2 other than the protrusions E. On the other hand, as illustrated in FIG. 11, in the third embodiment, the widths WE of the protrusions E are smaller than the widths WN of the portions of the second terminals T2 other than the protrusions E. In other words, the peripheral edges of the protrusions E in the Y direction are positioned inside the peripheral edges of the portions of the second terminals T2 other than the protrusions E in the Y direction.

In the configuration of the third embodiment, a distance is obtained between the protrusions E of the two adjacent second terminals T2. Accordingly, the possibility of short circuiting happening owing to the deformation of the protrusions E can be reduced. Note that the configuration of the third embodiment can also be applied to the configuration of the second embodiment.

Modifications

Each of the configurations described above illustrated as examples can be modified in various ways. Specific modification modes that can be applied to the embodiments described above will be exemplified below. Two or more modes optionally selected from the following examples may be combined appropriately as long as they do not contradict each other.

(1) In each of the embodiments described above, the first surface F1 of the first base portion 70 is exemplified as the mounting surface on which the first terminals T1 are formed; however, a surface of an element in the head unit 611 other than that of the first base portion 70 may be the mounting surface. For example, in a configuration in which the wiring connected to the electrodes of the piezoelectric elements 44 is formed on the surface of the diaphragm 42, the second wiring substrate 613 is bonded to the surface of the diaphragm 42 as the mounting surface. In other words, the element of the head unit 611 bonded to the second wiring substrate 613 with the adhesive agent is not limited to the first wiring substrate 46.

(2) In each of the embodiments described above, the height Hb of the protrusions E exceeds half the thickness Ha of the second terminals T2 at the portions where the protrusions E are situated; however, the height Hb of the protrusions E can be any height that protrudes at a height that exceeds the surface roughness of the second terminals T2.

(3) In each of the embodiments described above, an exemplary configuration in which the interval Ox between two protrusions E adjacent to each other in the X direction among the plurality of protrusions E formed in the second terminal T2 exceeds the length Lx of the protrusion E in the direction in which the second terminal T2 extends has been illustrated; however, the interval Ox may be smaller than the length Lx of the protrusion E.

(4) In each of the embodiments described above, although the configuration in which the interval Oy between the two second terminals T2 exceeds the length Lx of the protrusion E in the direction in which the second terminal T2 extend is illustrated, the interval Oy may be smaller than the length Lx of the protrusion E.

(5) In each of the embodiments described above, the cross-sectional shape of each protrusion E is rectangular; however, the cross-sectional shape of the protrusion E may be trapezoidal or triangular, for example. In other words, each protrusion E do not have to protrude at a height that is the same as the height Hb across the entire protrusion E.

(6) In each of the embodiments described above, the protrusion E having a rectangular planar shape is illustrated as an example; however, the planar shape of the protrusion E is not limited to the example described above. The planar shape of the protrusion E may be, for example, circular or oval.

(7) In each of the embodiments described above, a configuration may be employed in which the width WE of the protrusion E exceeds the width WN of the portion in the second terminal T2 other than the protrusion E.

(8) In the second embodiment, the positions of the protrusions E in the two second terminal T2 adjacent to each other are not limited to those in the configuration illustrated in FIG. 10 as long as the positions of the protrusions E in the direction in which the second terminals T2 extend are different.

(9) In the embodiments described above, a line type liquid ejecting apparatus 100 in which the plurality of nozzles N are distributed across the entire width of the medium 12 is described as an example; however, the present disclosure can be applied to a liquid ejecting apparatus 100 of a serial type in which a transport body on which the liquid ejecting heads 261 are mounted is reciprocated.

(10) The liquid ejecting apparatuses 100 described as examples in the embodiments described above may be employed in various apparatuses other than an apparatus dedicated to printing, such as a facsimile machine and a copier. Note that the application of the liquid ejecting apparatus 100 of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a head unit including a mounting surface on which a plurality of first terminals, to which a signal to eject ink from a nozzle is supplied, are formed; and a flexible wiring substrate including a plurality of second terminals that supply the signal to the head unit, the flexible wiring substrate bonded to the head unit with nonconductive paste while the second terminals and the first terminals are in an electrically coupled state, wherein the plurality of second terminals are arranged at pitches of 50 μm or less, protrusions in contact with surfaces of the first terminals are formed on surfaces of the second terminals, the protrusions protruding at a height exceeding a surface roughness of the second terminals, and an interval between two second terminals adjacent to each other in the plurality of second terminals exceeds a length of the protrusions in a direction in which the second terminals extend.

2. The liquid ejecting head according to claim 1, wherein in two second terminals adjacent to each other in the plurality of second terminals, positions of the protrusions in a direction in which the relevant second terminals extend are different.

3. The liquid ejecting head according to claim 1, wherein a plurality of protrusions are formed on a surface of each of the second terminals in a direction in which the second terminals extend.

4. The liquid ejecting head according to claim 3, wherein an interval between two protrusions adjacent to each other in the plurality of protrusions formed on each of the second terminals exceeds a length of the protrusions in the direction in which the second terminals extend.

5. A liquid ejecting apparatus comprising:

a liquid ejecting head according to claim 1.

6. A flexible wiring substrate bonded, with nonconductive paste, to a head unit including a mounting surface on which a plurality of first terminals, to which a signal to eject ink from a nozzle is supplied, are formed, the flexible wiring substrate comprising:

a plurality of second terminals electrically coupled to the plurality of first terminals, the plurality of second terminals configured to supply the signal to the head unit, wherein the plurality of second terminals are arranged at pitches of 50 μm or less, protrusions in contact with surfaces of the first terminals are formed on surfaces of the second terminals, the protrusions protruding at a height exceeding a surface roughness of the second terminals, and an interval between two second terminals adjacent to each other in the plurality of second terminals exceeds a length of the protrusions in a direction in which the second terminals extend.

7. The wiring substrate according to claim 6, wherein a height of the protrusions exceeds half a thickness of the second terminals at portions where the protrusions are located.

* * * * *